United States Patent [19]

Tanaka

[11] 4,299,182

[45] Nov. 10, 1981

[54] TWO-WAY OPERATION SYSTEM CONTROL DEVICE FOR SEWING MACHINES

[75] Inventor: Yoshikazu Tanaka, Hachioji, Japan

[73] Assignee: Janome Sewing Machine Co., Ltd., Tokyo, Japan

[21] Appl. No.: 59,206

[22] Filed: Jul. 19, 1979

[30] Foreign Application Priority Data

Jul. 28, 1978 [JP] Japan ..... 53-103076[U]

[51] Int. Cl.[3] ..... D05B 69/18

[52] U.S. Cl. ..... 112/277; 318/305; 318/551

[58] Field of Search ..... 112/277, 275, 220; 318/305, 336, 546, 551

[56] References Cited

U.S. PATENT DOCUMENTS 4,078,506 3/1978 Sasaki ..... 112/277 X 4,098,206 7/1978 Suchsland et al. ..... 112/277 X

*Primary Examiner*—Peter P. Nerbun

*Attorney, Agent, or Firm*—Michael J. Striker

[57] ABSTRACT

A speed control device for a sewing machine having a drive motor, includes a foot controller with a variable resister and a depressable operating plate; depending upon the extent to which the plate is depressed the variable resister provides a variable resistance value for the motor. The controller also has manually operable push buttons each sewing to selectively connect one of several different fixed-value resistors in circuit with the drive motor. A changeover switch connects the variable resistor into the motor circuit when the plate is depressed and disconnects the variable resister from the circuit while connecting the fixed resistors into the circuit, when the plate is not depressed.

4 Claims, 4 Drawing Figures

TWO-WAY OPERATION SYSTEM CONTROL DEVICE FOR SEWING MACHINES

BRIEF DESCRIPTION OF THE INVENTION

The invention relates to a sewing machine, and more particularly relates to a two-way operation system control device for a sewing machine. According to the invention, a machine controller is incorporated with a step pedal operation system and a push button operation system, and either of the two systems is switched over to be effective by operating one of the systems.

Various kinds of speed controllers for sewing machines have been hitherto provided. But according to these conventional devices, the push button operation system is one and the step pedal operation system is another, that is, these two operation systems are independent from each other. It is, therefore, necessary for a machine operator to exchange this system for that system in dependence upon the place in which the sewing machine is used or in dependence upon the kind of the sewing machine. Apart from such a troublesome preparation work required on the side of the machine operator, the production cost of such conventional speed control devices is comparatively high and accordingly the economical burden becomes much on the side of these who purchase such devices.

The present invention has been provided to eliminate such defects and disadvantages of the prior art.

It is, therefore, a primary object of the invention to arrange a step pedal operation system and a push button operation system in a single machine controller for convenience of selective usage of these systems by the machine operator.

It is another object of the invention to make selectively effective either of the two systems by operating one of the two systems.

The other features and advantages will be apparant from the following description of the invention in reference to the preferred embodiments as shown in the attached drawings.

DETAILED DESCRIPTION OF THE INVENTION

Figure 1:
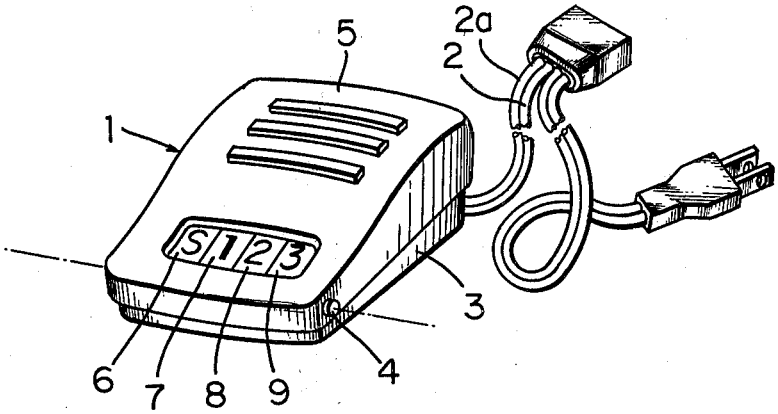
FIG. 1 shows an outer appearance of a two-way operation system speed control device of the invention.

This invention will be explained in reference to the attached drawings. In FIG. 1, a numeral 1 is a machine controller incorporating the invention. The controller has nodes 2, 2*a*, connected to a machine motor M housed in the sewing machine. Numeral 5 identifies a step plate pivoted around a shaft 4 and biased by a spring in the upper direction with respect to a base 3 of the controller 1. The reference numerals 6 and 7, 8, 9 are push button switches for driving the machine motor M in different modes, namely a stopping switch and a low speed driving switch, a middle speed driving switch, and a high speed driving switch.

Figure 2:
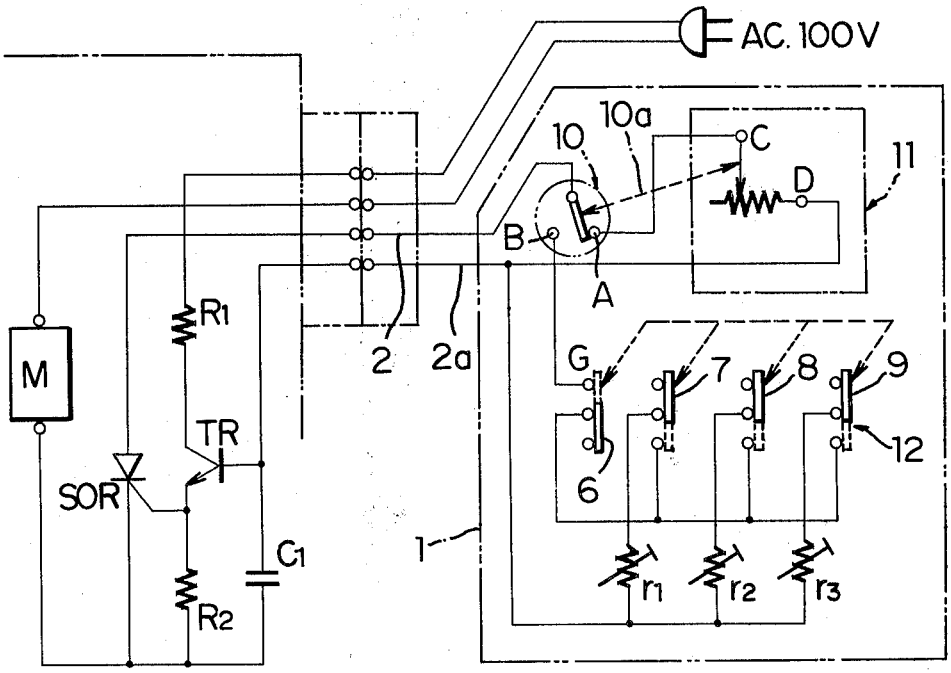
FIGS. 2–4 show the circuit diagramms of the other embodiments of invention respectively.

In FIG. 2, numeral 10 is a change-over switch housed in the controller. Numeral 11 identifies a variable resistor for reducing resistance between terminals C–D as the pressing down amount of the step plate 5 increases. Numeral 12 identifies a resistance selecting device which, if the button switches 6–9 are selectively pushed, makes the resistance value between the terminal G and said code 2*a* infinite (OFF condition) or changes the resistance value to one of the predetermined values of semi-fixed resistors $r_1$, $r_2$, $r_3$. The push button switches 6–9 are so structured that if any one of them is pushed down, the previously pushed one is returned to the initial position. The change-over switch 10 is connected by a link 10*a* to the step plate 5 in such a manner that when the step plate 5 is pushed down, the switch 10 engages a contact A, and engages a contact B when the step plate 5 is released and returned to the upper initial position.

Figure 3:
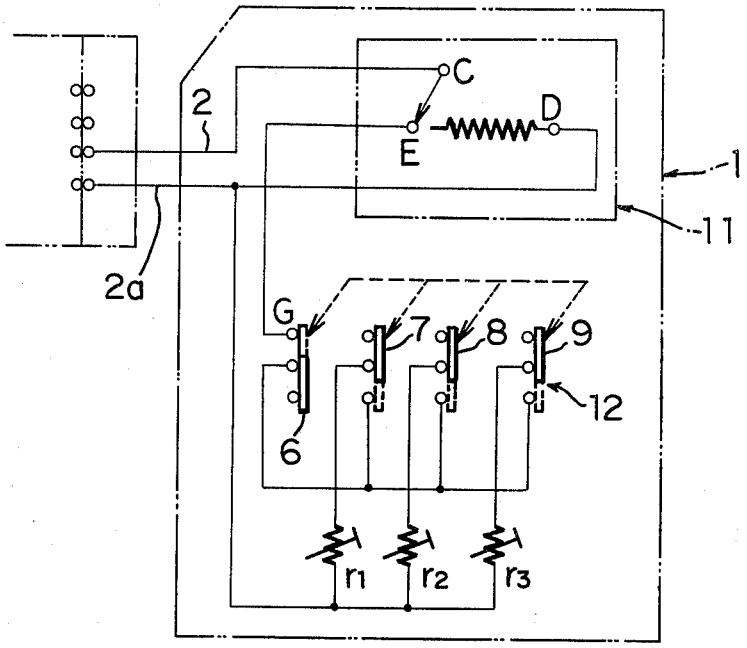
Figure 4:
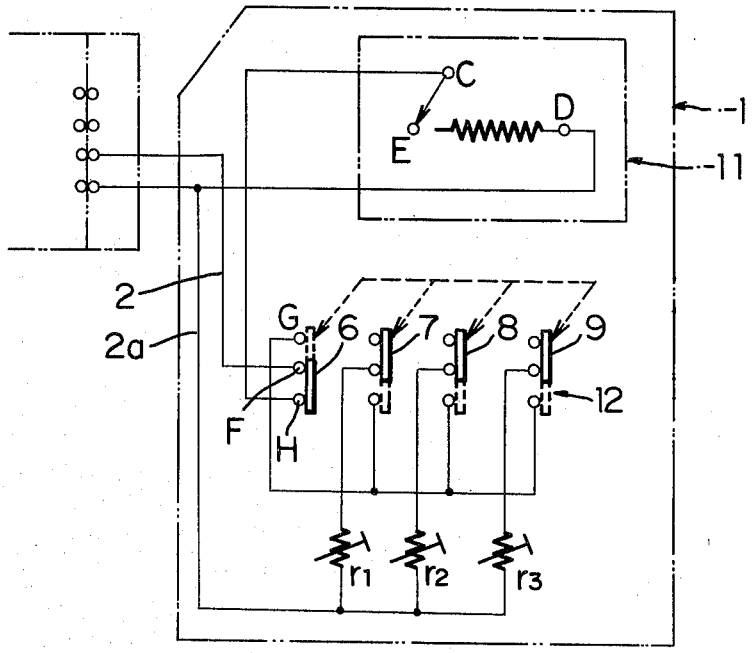

The first embodiment of the invention is as mentioned above. When the step plate is not pushed down, the sewing machine can be driven a selected speed with proper speed (including stop) by selectively pushing one of the push buttons 6–9. On the other hand, when the step plate 5 is pushed down, the switch 10 is instantly changed over to the contact A, and therefore the rotation speed of sewing machine can be smoothly controlled in accordance to the pushing amount of the step plate 5. On the other hand, the terminal C of the variable resistor 11 may be disconnected from the resistance and connected to another contact E as shown in FIGS. 3 and 4 immediately after the step plate 5 has been released. In this case, the contact C is connected to the node 2 as shown in FIG. 3 (a second embodiment) and the contact E is connected to a contact G of the resistance selecting device 12, thereby to provide the same effect as in the first embodiment.

The above mentioned embodiments realize the two-way operation system speed control of the machine by means of the operation of step plate 5 which makes the variable resistor 11 effective or ineffective. FIG. 4 shows a third embodiment in which the variable resistor is made effective or ineffective by manipulation of the resistance selecting device 12. Namely when any one of the resistors $r_1 \ldots r_3$ is not selected, a contact F and a contact H are short-circuited, and when any one of the resistors is selected, the contact F is connected to the contact G, and when the node 2 is connected to the contact F and the contact C is connected to the contact H, a desired rotation speed of the sewing machine is selected by operating one of the push buttons 7, 8, 9. If the push button is pushed down, the contacts F and G are broken and the sewing machine is stopped. At the same time, since the contact F is switched to the contact H, the speed control of the sewing machine by operation of the step plate 5 is possible as far as the push button is pushed down.

The embodiments of the present invention show that the speed control is carried out by altering the direct current resistance value in the semi-conductor control circuit connected to the machine motor M between the nodes 2 and 2*a*. This may, however, be replaced by something altering the capacity of the capacitor.

I claim:

1. A speed control device for a sewing machine comprising a machine drive motor; and a foot controller including a variable resistor providing a variable resistance value to drive the machine drive motor in dependence upon the operation of the foot controller, said foot controller being provided with a plurality of hand-operated means, fixed resistors each specific to and in operative connection with one of said hand-operated means, and a changeover switch, said changeover switch being displaced to a first position for connecting the variable resistor to the machine drive motor when the foot controller is operated and being displaced to a second position for connecting the fixed resistors in circuit with the machine drive motor when the foot controller is released, said hand-operated means being selectively operable to selectively connect respective ones of the fixed resistors to the machine drive motor.

2. A speed control device as defined in claim 1, wherein said hand-operated means includes a push button which is operable to disconnect the hand-operated means from the machine motor.

3. A speed control device as defined in claim 1, wherein the hand-operated means includes a switch which is operable to give effect to the operation of the foot controller and to make ineffective the hand-operated means.

4. A speed control device as defined in claim 1, wherein said hand-operated means comprises a number of push buttons selectively operable to thereby drive the machine motor with a speed predetermined by a resistance value.

* * * * *